US005652406A

United States Patent [19]

Phan

[11] Patent Number: 5,652,406

[45] Date of Patent: Jul. 29, 1997

[54] MUZZLE BRAKE

[75] Inventor: Ketchong Phan, Farnborough, Great Britain

[73] Assignee: The Secretary of State for Defence in Her Britannic Majesty's Government of the United Kingdom of Great Britain and Northern Ireland, a British Corporation Sole, London

[21] Appl. No.: 556,993

[22] PCT Filed: Jun. 3, 1994

[86] PCT No.: PCT/GB94/01216

§ 371 Date: Dec. 20, 1995

§ 102(e) Date: Dec. 20, 1995

[87] PCT Pub. No.: WO94/29663

PCT Pub. Date: Dec. 22, 1994

[30] Foreign Application Priority Data

Jun. 9, 1993 [GB] United Kingdom ..... 9311900

[51] Int. Cl.[6] ..... F41A 21/00

[52] U.S. Cl. ..... 89/14.3

[58] Field of Search ..... 89/14.3

[56] References Cited

U.S. PATENT DOCUMENTS 5,020,416 6/1991 Tripp ..... 89/14.3

5,036,747 8/1991 McClain ..... 89/14.3

FOREIGN PATENT DOCUMENTS 2680235 2/1993 France .

85685 1/1895 Germany .

100272 2/1898 Germany .

299449 1/1930 United Kingdom .

*Primary Examiner*—J. Woodrow Eldred

*Attorney, Agent, or Firm*—Nixon & Vanderhye

[57] ABSTRACT

A muzzle brake for reducing gun recoil comprises a hollow cylindrical tube (7) having an open forward end and having at least two apertures in the cylinder wall (4) each which is provided with closure means (6) mounted on the tube so as to be movable between a closed position and a fully open position. Each closure means (6) has at least one associated biasing member (22) to bias it into the closed position, which is preferably preloaded to introduce an inertia into the movement of the closure means (6) which is of such a degree that the rapid blast pressure wave passes with little effect, but the longer exhaust wave effects opening. The brake further comprises at least one rearwardly directed gas deflecting surface (13, 30) to deflect the exhaust wave gases rearwards and produce a braking effect.

18 Claims, 8 Drawing Sheets

MUZZLE BRAKE

This invention relates to a muzzle brake for reducing the recoil resulting from the firing of a gun.

Muzzle brakes are used to reduce the recoil experienced by a gun when it is fired. They work by utilizing the forward momentum of the pressure wave produced by expanding exhaust gas which follows the firing of the gun, deflecting some of that exhaust gas rearwards to produce a forward impulse on the brake which balances to some degree the recoil impulse on the gun barrel.

Prior art muzzle brake systems suffer from the disadvantage that they interact with the very high pressure short duration blast wave which occurs immediately after the projectile has left the muzzle, in addition to the subsequent longer duration exhaust pressure wave produced by expanding exhaust gases. This blast wave is directed rearwards by the muzzle brake, increasing the blast overpressure in the region behind the gun and exposing the gun crew to increased hazard. The blast is then followed by the exhaust pressure wave which lasts in the order of milliseconds.

A standard configuration of muzzle brake comprises a metal block connected to the front of the muzzle having an aperture on the inside surface of the barrel and passages configured to direct exhaust gases rearwards. Following firing of the gun some of the pressurized exhaust gas escapes through this aperture and is deflected rearwards, attenuating the recoil impulse on the barrel. However, the metal block type of brake allows a considerable quantity of exhaust gas to pass forward through the muzzle, and thus is relatively inefficient and only reduces the recoil force by approximately 50%.

Howitzers normally employ a design of brake which is more effective at reducing recoil. A howitzer style brake includes a structure supported in front of the muzzle having a larger diameter than that of the barrel and partially closed by an annulus defining a rearwardly directed pressure surface at its forward end. Pressurized exhaust gas expands into the volume defined by the structure and is deflected rearwards through apertures in the structure by the annulus. The design increases the proportion of exhaust gas which is deflected rearwards, and thus increases the degree to which the recoil impulse is attenuated.

Certain designs of muzzle brake utilise the pressure of the gases produced to effect closing of the barrel. FK-A-2, 680,235 discloses a brake which has pivoting flaps which close off the barrel and direct the gases through rearwardly directed nozzles. DE-C-0,100,272 discloses a device which has opening valves in the barrel wall, the opening of the valves causing a slide to close off the barrel.

The application of muzzle brakes to guns from which saboted projectiles are to be launched also presents problems, as the disruption of the blast pressure wave by the brake can interfere with the sabot discarding process. This is particularly true of howitzer type muzzle brakes, which are found to be entirely unsuitable when launching saboted projectiles.

It is an object of the present invention to provide a muzzle brake for attachment to the muzzle of a gun barrel which minimizes interaction with the blast pressure wave from the barrel, but which interacts with the exhaust gas pressure wave by deflecting a significant proportion of the exhaust gas rearwards, so as to attenuate the recoil impulse on the barrel with minimum increase of the blast overpressure in the region behind the gun.

Thus according to the invention there is provided a muzzle brake locatable at the forward end of a gun barrel comprising a hollow cylindrical tube having an open forward end and having at least two apertures in the cylinder wall, each of the apertures being provided with associated closure means mounted on the hollow cylindrical tube so as to be movable between a closed position and a fully open position wherein each of the closure means has at least one associated biasing member acting on it to bias the closure means into the closed position, said biasing members being preloaded to a predetermined level so as to introduce an inertia into the movement of the closure means such that the gases produced during the blast pressure wave, which immediately follows firing of a gun, pass through the muzzle brake without effecting significant opening of the closure means, and at least One surface which functions as a rearwardly directed gas deflecting surface when the closure means are in an open position.

Consequently, with the closure means in the closed position the apertures in the cylinder wall are sealed so that the cylindrical tube and the closure means form a sealed pressure surface. In use in this configuration located at the forward end of a gun barrel the muzzle brake allows gases from the barrel to pass only through its open forward end. If the closure means are moved from the closed position to an open position the apertures in the cylinder wall are no longer sealed and gases from the barrel are also able to escape via those apertures.

Each closure means includes at least one biasing member to bias the closure means in the closed position. The apertures in the cylinder wall are then sealed in the absence of gas overpressure inside the muzzle brake. If the biasing members are preloaded to a greater degree than may be necessary to perform a simple closure function this will, in conjunction with the mass of the closure means, introduce an inherent inertia to the opening mechanism. By preloading the biasing members to an appropriate predetermined level it is possible to introduce sufficient inertia that when a gun incorporating the device is fired the high pressure blast wave, which is of a relatively very short duration, produces only a limited effect on the closure means, and only a minimal escape of gases from the blast pressure wave through the apertures takes place. The device is thus able to function as an efficient muzzle brake during the exhaust gas ejection phase, but allows the blast pressure wave to pass through largely unaffected. The increase in blast overpressure in the region behind the gun when it is fired and the consequent problems posed for operators in that area are thus kept to a minimum.

The pressure wave of the exhaust gas ejection phase, being of a relatively much longer duration, overcomes this inertia, causing the closure means to be moved towards their fully open position which enables a significant proportion of the exhaust gases to pass through the apertures. These can be deflected rearwards by a suitable gas deflecting arrangement to produce a braking effect which can be significantly greater than that produced by a simple metal block but which unlike howitzer brakes causes little disturbance to the blast wave so that use of the invention with saboted projectiles can be contemplated.

Each of the closure means is preferably mounted so as to rotate about an axis located between its associated aperture in the cylinder wall and the forward end of the cylindrical tube. Thus mounted, when the closure means are not in the closed position the internal surface of each of the closure means functions as a pressure surface capable of deflecting rearwards gases from the gun barrel, thereby transferring some of the momentum of those gases rearwards and attenuating the recoil impulse on the barrel to produce a braking effect.

A more efficient braking effect is achieved however if the muzzle brake includes at least one braking member fixedly located towards the forward end of the cylindrical tube and each having a rearwardly facing braking surface configured such that in use the at least one braking surface contributes to rearward deflection of gases exiting the muzzle brake via the apertures.

The braking effect is maximized if a continuous gas deflecting surface is provided. Therefore, the muzzle brake preferably includes a single braking member having a braking surface providing a rearwardly directed gas deflecting surface which is continuous about the circumference of the muzzle brake. Alternatively, if more than one braking member is used or if a single braking member incorporates discontinuities, for example slots to accommodate the function of a mechanism operating the closure means, the at least one braking member is preferably so configured as to combine with the closure means so that the braking surface of the at least one braking member and the internal surfaces of the closure means when in the fully open position provide a rearwardly directed gas deflecting surface which is effectively continuous about the circumference of the muzzle brake.

The simplest form of braking member is an annular disc, presenting a planar braking surface lying perpendicular to the axis of the cylindrical tube. However, a more efficient braking effect is produced if the rearwardly directed gas deflecting surface is concave.

The rearwardly directed gas deflecting surface is preferably predominantly frustoconical, with the frustum corresponding to the circumference of the cylindrical tube. In embodiments of the invention where the gas deflecting surface is configured from a braking surface/internal surface of closure means combination a completely frustoconical gas deflecting surface is not achievable, but each braking surface should comprise a segment of a frustoconical surface, and the closure means in the fully open position should lie in recesses therein to provide a continuous and predominantly frustoconical gas deflecting surface.

The frustoconical gas deflecting surface preferably has a projected apex angle of between 80° and 140°, more preferably between 100° and 120° and most preferably substantially 110°.

To minimize any lateral impulse from the action of exhaust gases the apertures in the cylinder wall are preferably identical in size and circumferentially equispaced.

Each closure means is preferably fixed with respect to a shaft, which shaft is pivotably mounted on the muzzle brake such that its associated closure means is movable from the closed position. In this embodiment, each biasing member preferably acts directly on a shaft so as to bias the closure means into the closed position, and preferably comprises a coil spring or a torsionally mounted helical spring. Each of the closure means is preferably provided with a pair of biasing members acting thereon.

Each closure means may be provided with a forward extension and muzzle closure flap which are so configured that when all the closure means are in the fully open position their respective muzzle closure flaps together substantially close the forward end of the cylindrical tube, inhibiting the passage of exhaust gases out of the forward end so that substantially all exhaust gases are forced to pass through the apertures. An increased braking impulse is thereby produced.

The muzzle brake is conveniently configured to be attachable to a gun barrel, in which embodiment the hollow cylindrical tube is provided with a rearward end connectable to the muzzle of a gun. Alternatively, a unitary construction may be provided wherein the hollow cylindrical tube is continuous with the gun barrel and constitutes the forward section thereof.

The invention will now be described by way of example only with reference to FIGS. 1 to 10 which show;

Figure 1:
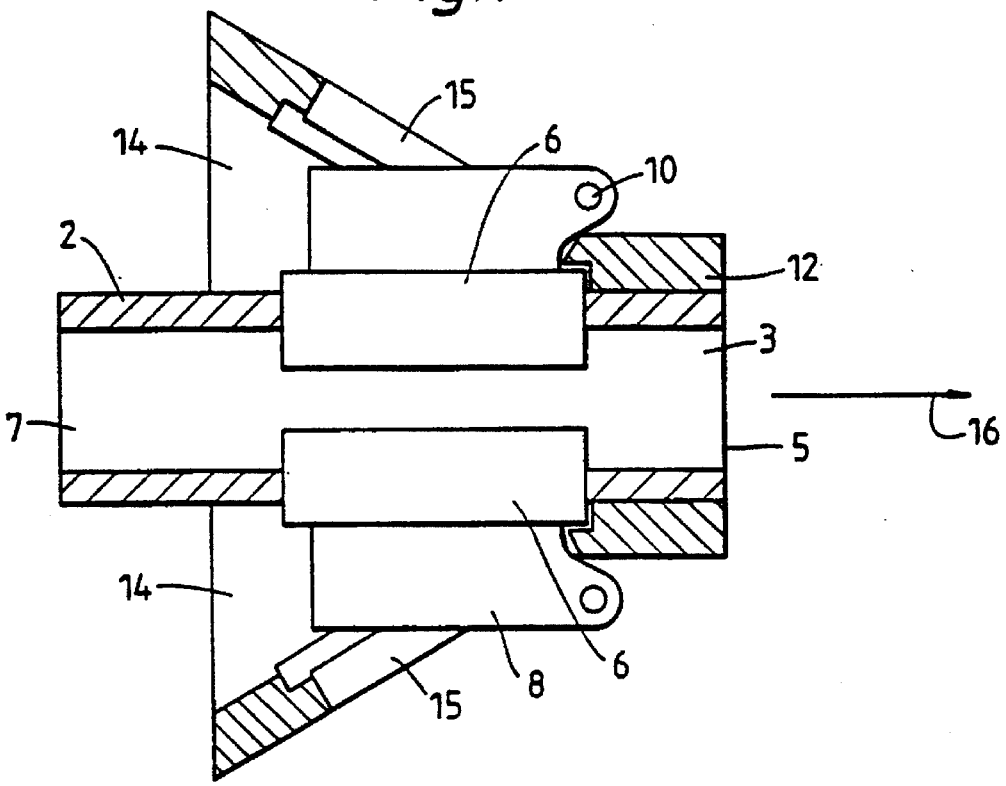
FIG. 1 is a schematic partial cross section of an embodiment of muzzle brake according to the invention wherein the closure means are in the closed position.
Figure 2:
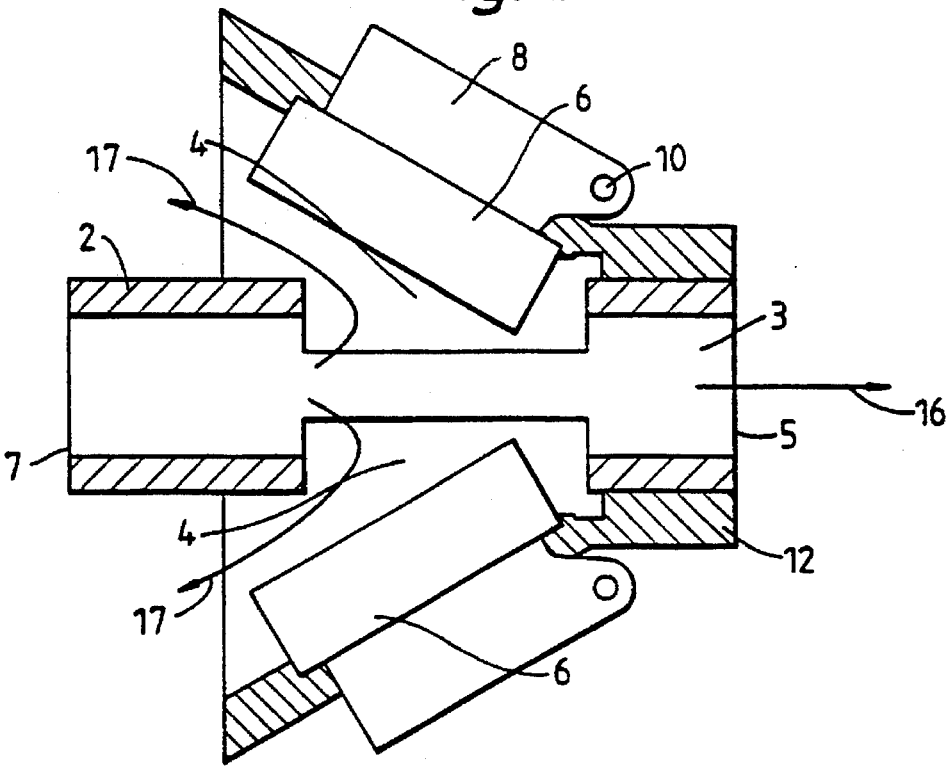
FIG. 2 is a schematic partial cross section of the muzzle brake shown in FIG. 1 wherein the closure means are in the open position.
Figure 4:
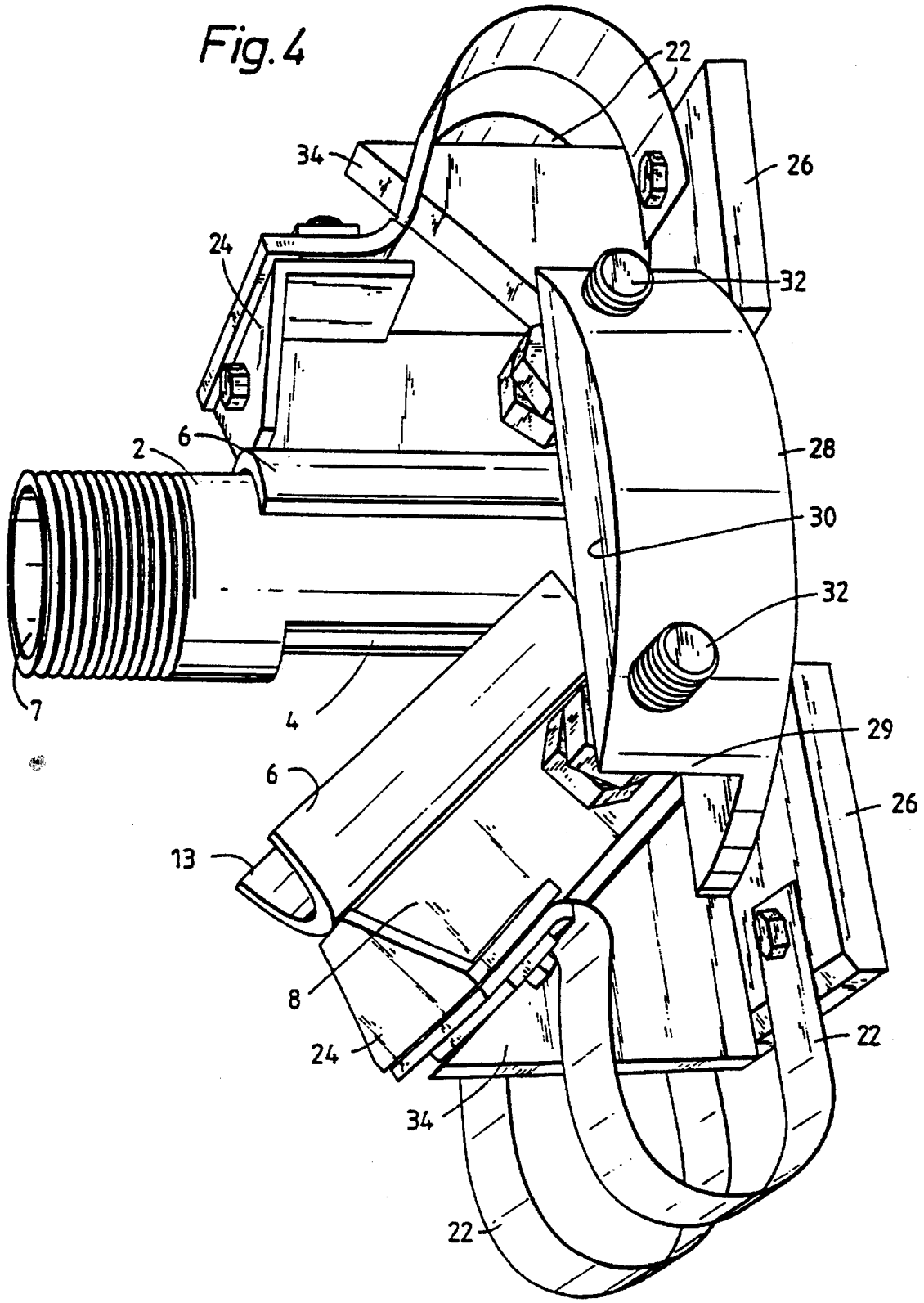
Figure 5:
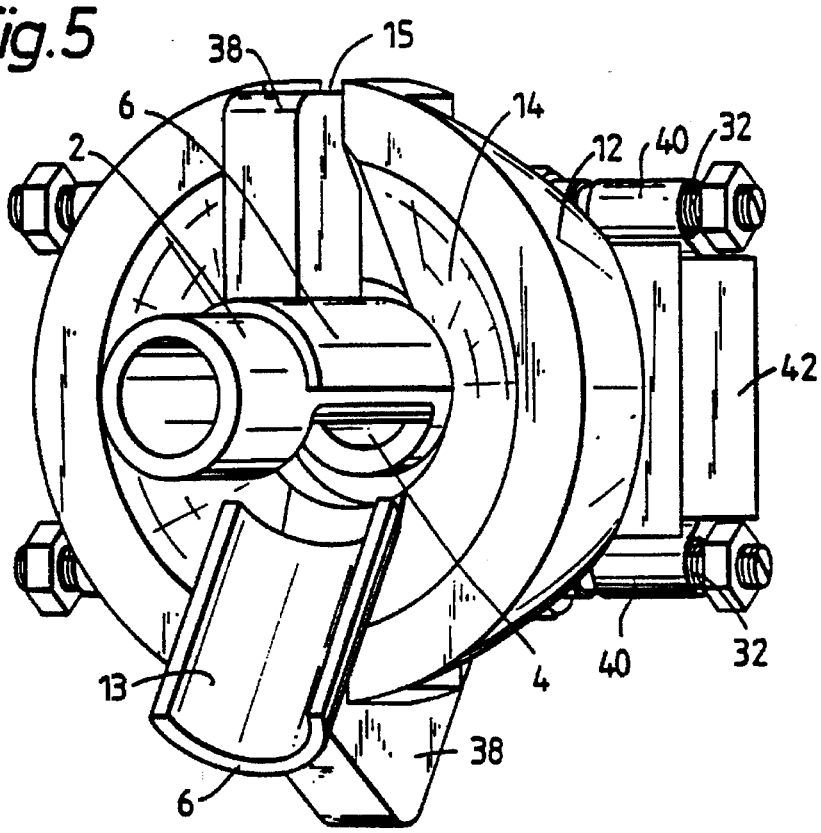
Figure 6:
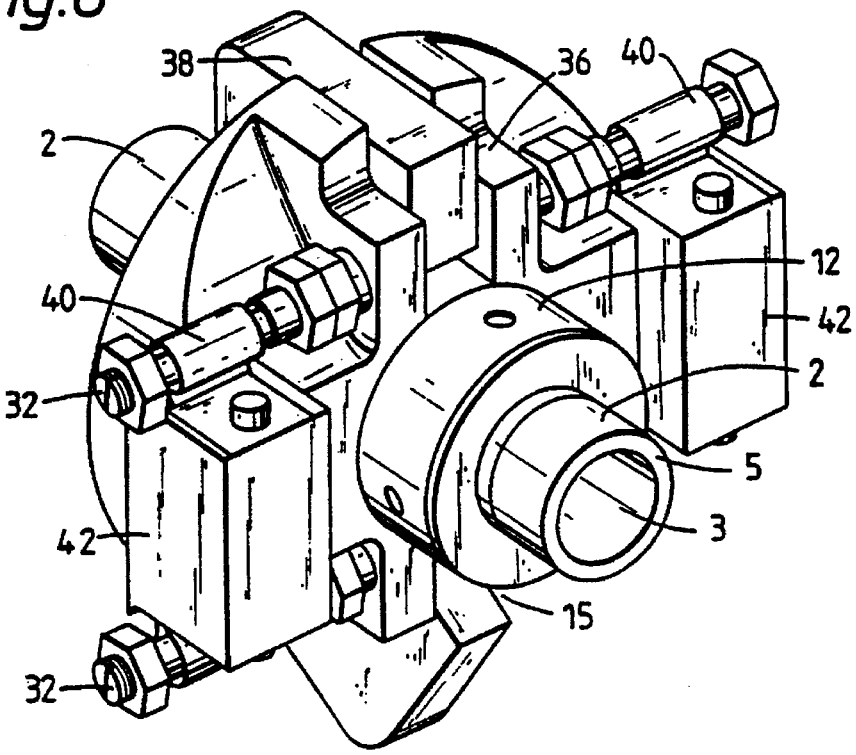
Figure 7:
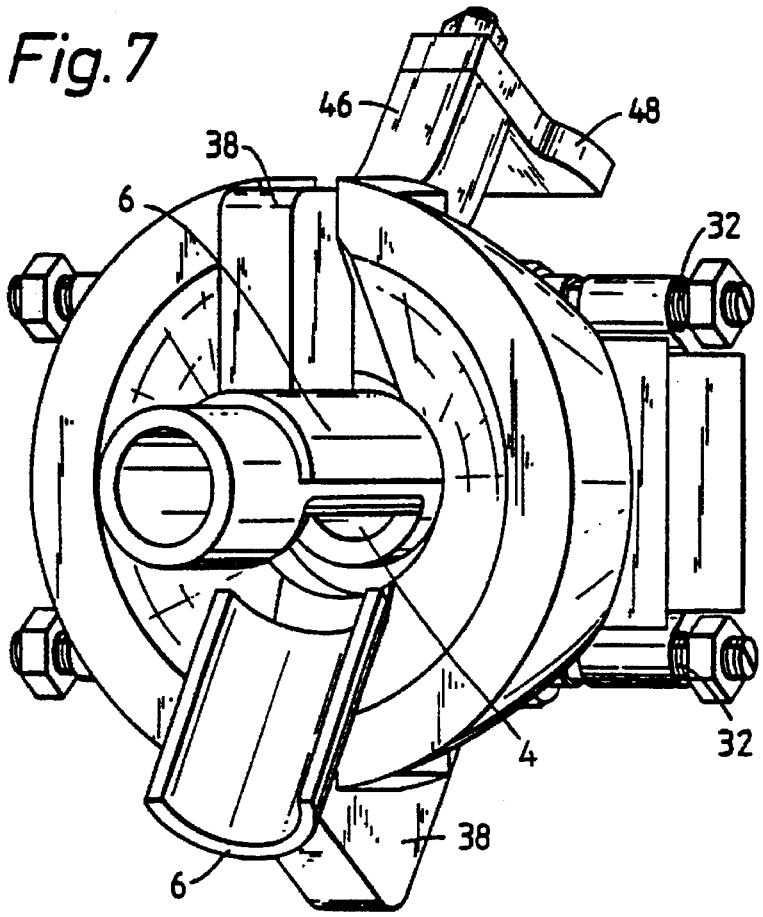
Figure 8:
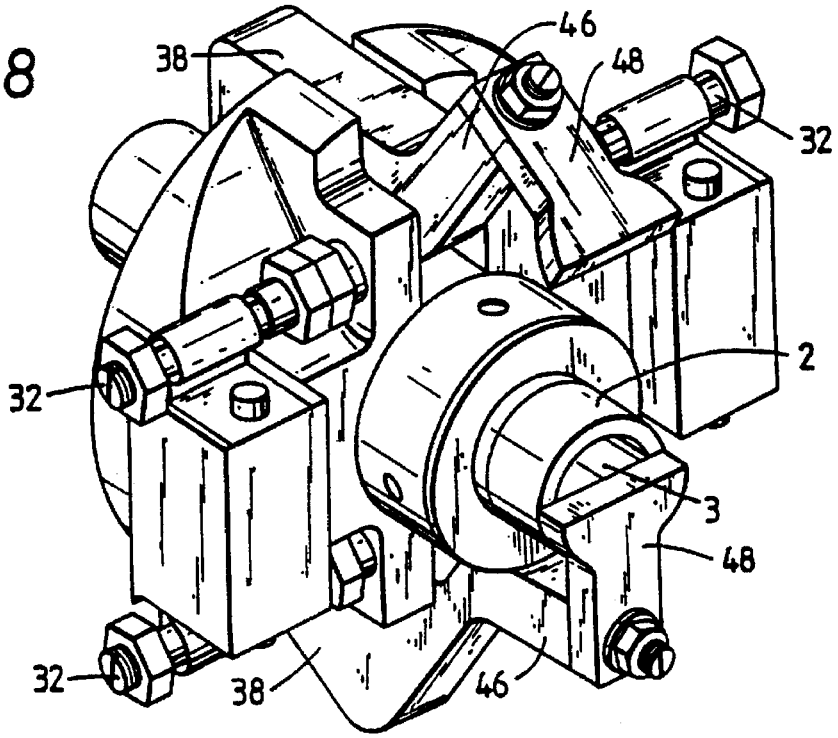
Figure 9:
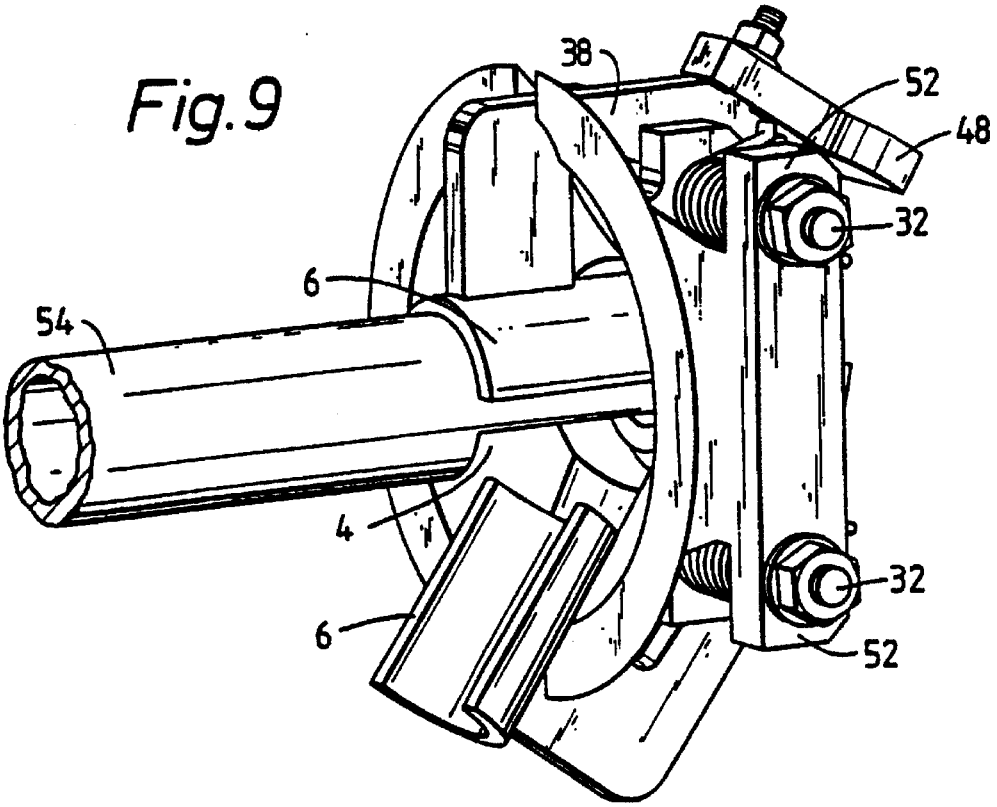
Figure 10:
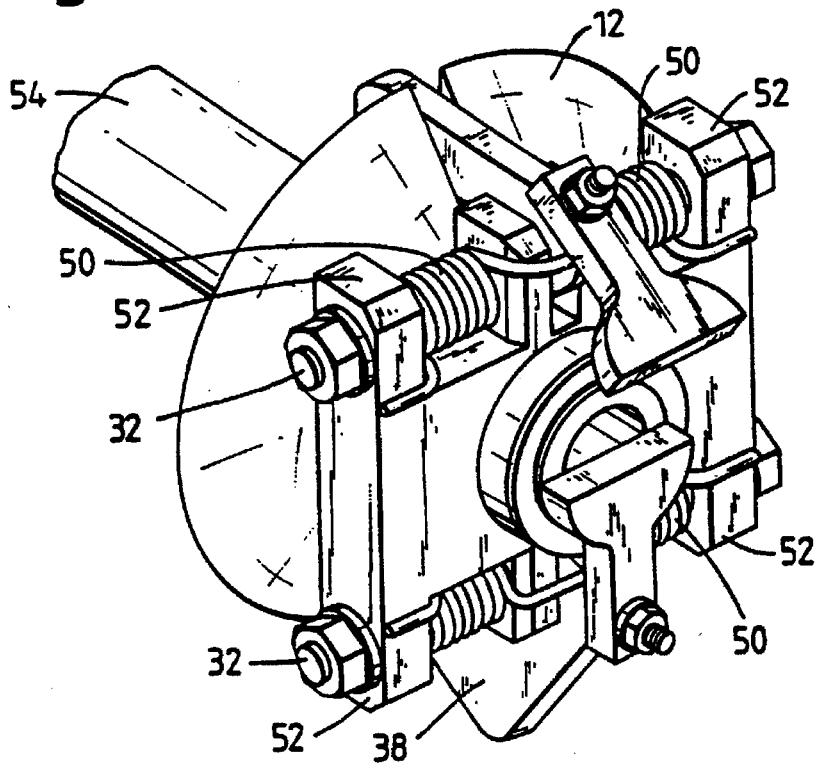

FIGS. 3*a*–3*f* are schematic illustrations of the operation of the muzzle brake shown in FIGS. 1 and 2 during a complete cycle of blast and exhaust pressure waves which follows the firing of a gun;

FIG. 4 is a perspective view of an alternative embodiment of muzzle brake according to the invention;

FIG. 5 is a perspective view of an alternative embodiment of muzzle brake according to the invention;

FIG. 6 is a perspective view of the muzzle brake shown in FIG. 5 from an alternative angle;

FIG. 7 is a perspective view of an alternative embodiment of muzzle brake according to the invention;

FIG. 8 is a perspective view of the muzzle brake shown in FIG. 7 from an alternative angle;

FIG. 9 is a perspective view of an alternative embodiment of muzzle brake according to the invention;

FIG. 10 is a perspective view of the muzzle brake shown in FIG. 9 from an alternative angle.

A muzzle brake constructed according to an embodiment of the invention is shown in partial longitudinal cross section in FIGS. 1 and 2 in the closed and an open configuration respectively. The muzzle brake comprises a hollow cylindrical tube 2 having two identical arcuate apertures 4 located opposite each other in the cylinder wall. In the closed configuration (FIG. 1) each aperture 4 is sealed by an arcuate closure flap 6. Each closure flap 6 has an associated supporting rib 8, pivotably mounted so as to be rotatable about a pivot 10 from the closed configuration of FIG. 1 to the open configuration of FIG. 2. Mounted at the forward end 5 of the cylindrical tube 2 is a braking member 12 which has a rearwardly extending portion of increased diameter so as to define a rearwardly directed concave braking surface 14 which is continuous about the circumference of the muzzle brake except where provision is made in the form of a slot 15 to accommodate each supporting rib 8 as the brake moves to an open configuration.

In use the rearward end 7 of the cylindrical tube 2 is attached to the barrel of a gun. In the closed configuration (FIG. 1) each aperture 4 is sealed by its associated closure flap 6, and all exhaust gases from the barrel pass out of the circular aperture 3 at the forward end 5 of the cylindrical tube 2 in the direction of the arrow 16. In the open configuration of FIG. 2 some of the exhaust gases pass through the apertures 4 and are deflected rearwards by the concave braking surface 14 in the direction of the arrow 17. The forward impulse thus produced on the braking surface partially attenuates the recoil impulse on the gun producing a braking effect.

The operational cycle of the muzzle brake of FIGS. 1 and 2 is illustrated by FIG. 3 *a*–*f*.

Figure 3A:
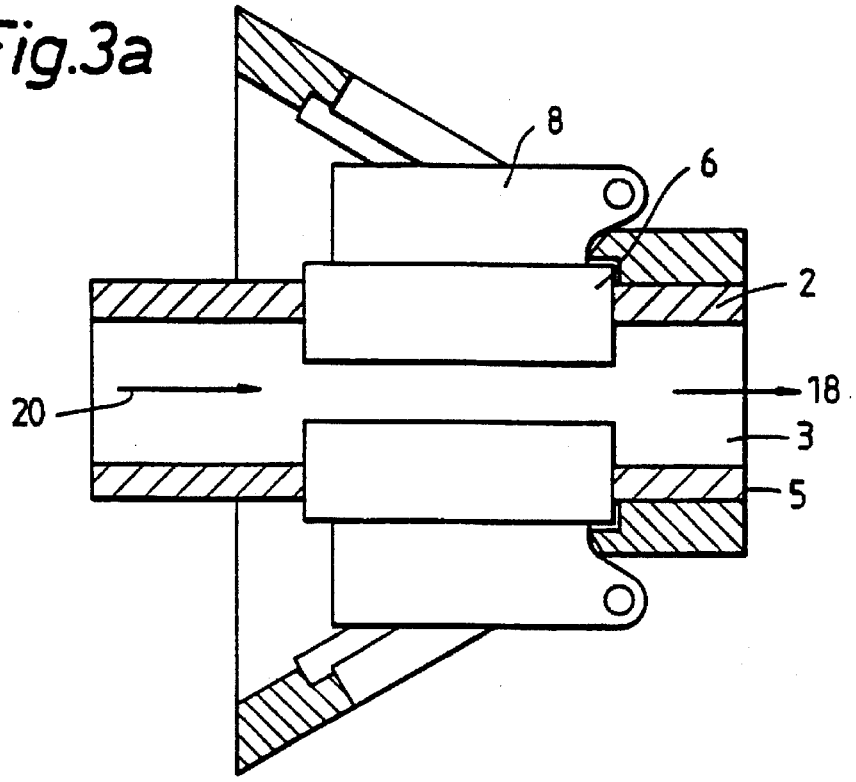

FIG. 3*a* represents the position immediately after the gun is fired. The closure flaps 6 and supporting ribs 8 are in the closed position and are retained in that position by spring biasing (not shown in FIG. 3). This gives the system an inherent inertia which the high intensity blast pressure wave is of too short a duration to overcome, and the gases associated with the blast 18 emerge unhindered through the circular aperture 3 at the forward end 5 of the cylindrical tube 2.

Figure 3B:
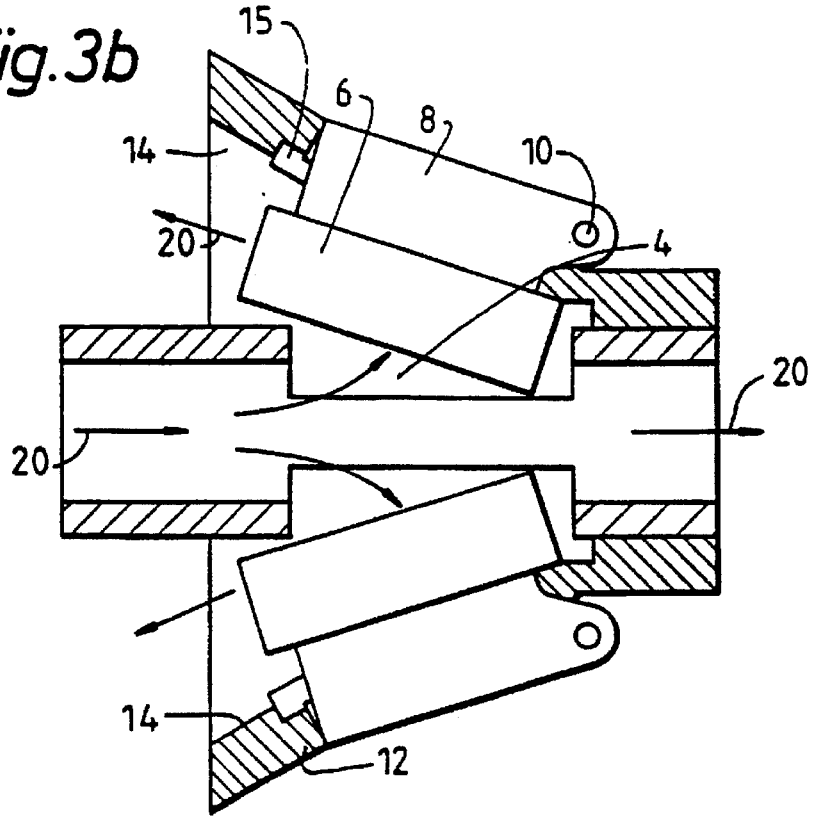
Figure 3C:
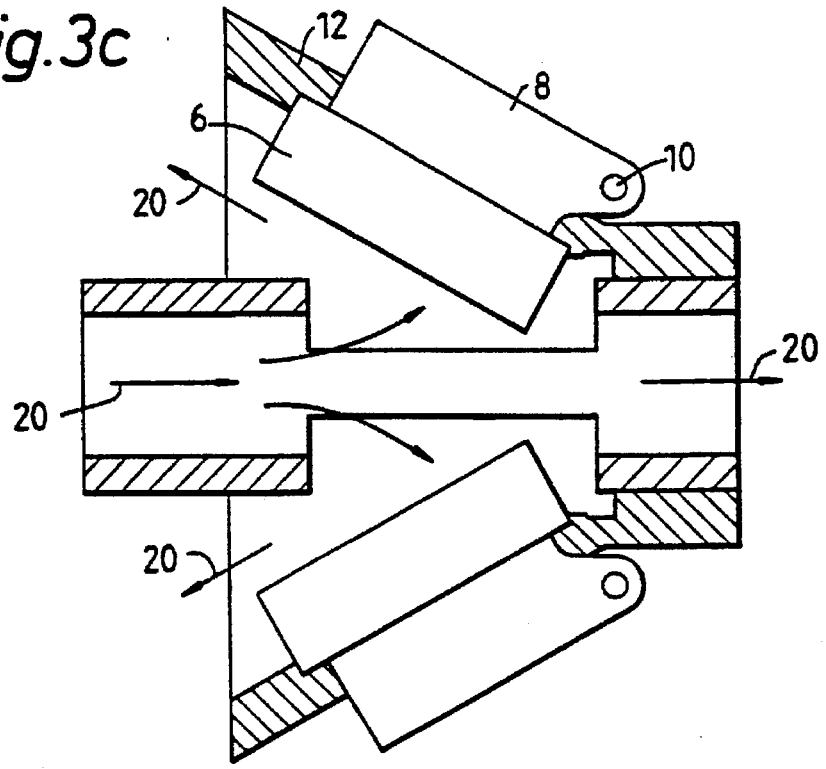
Figure 3D:
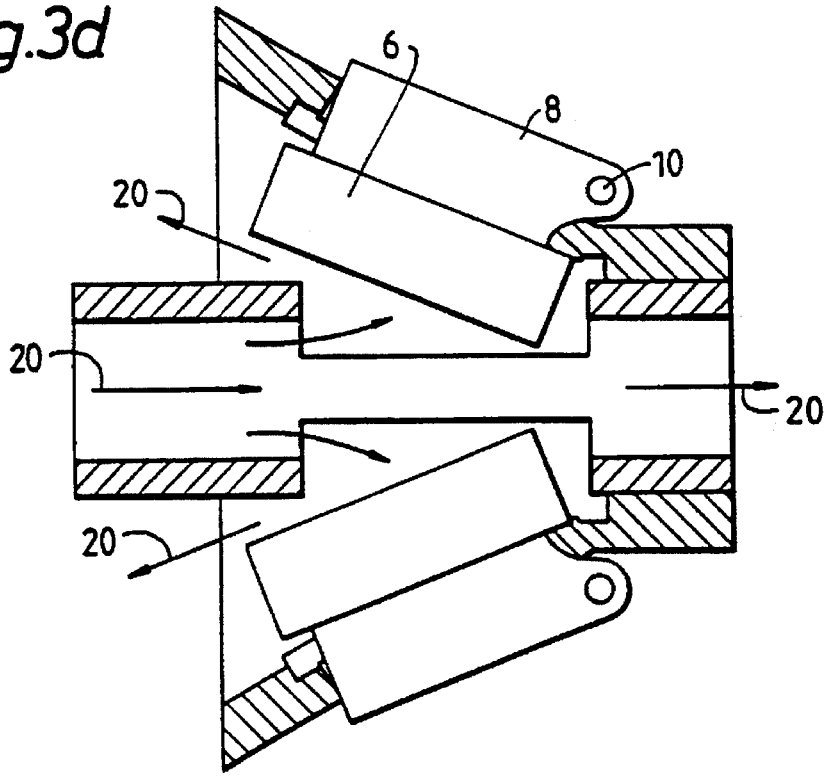
Figure 3E:
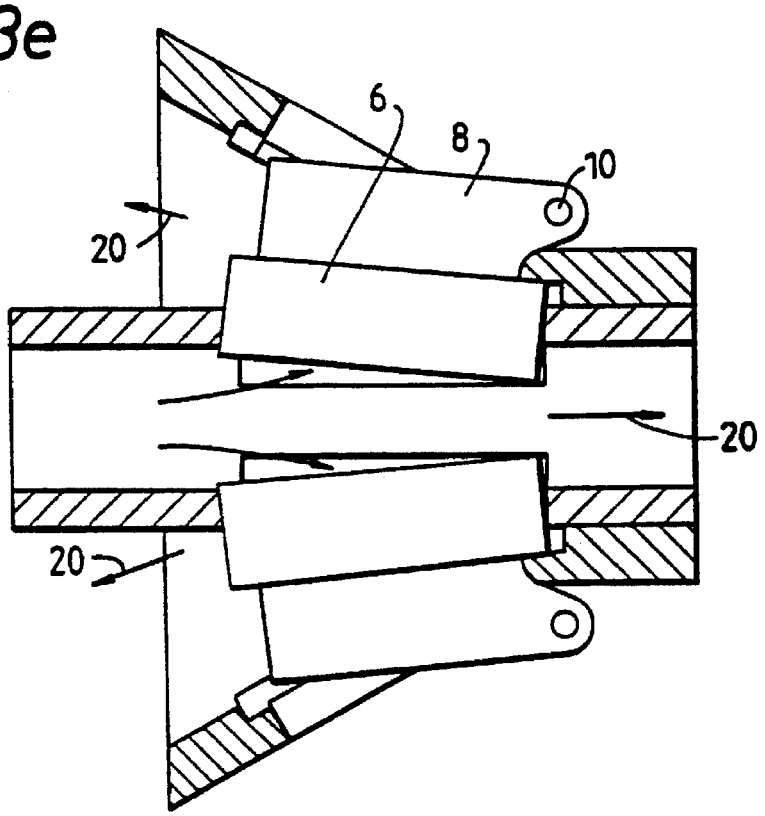

The exhaust gases 20 have an associated pressure wave of relatively much longer duration, and this pressure acts on the internal surfaces of the closure flaps 6 to overcome the inherent inertia of the closure system and cause the supporting ribs 8 to rotate about the pivots 10 opening the apertures 4 (FIG. 3*b*). Some of the exhaust gases 20 can then pass through the apertures 4 and are deflected rearwards by the internal surfaces of the closure flaps 6 and the concave braking surface 14 to produce a braking effect. Under the influence of exhaust gas pressure the supporting ribs 8 continue to rotate about the pivots 10 until a fully open configuration is reached where the closure flaps 6 lie snugly within the slots 15 in the braking member 12 so as to produce a circumferentially continuous rearwardly directed gas deflecting surface to maximize the braking effect (FIG. 3*c*).

Figure 3F:
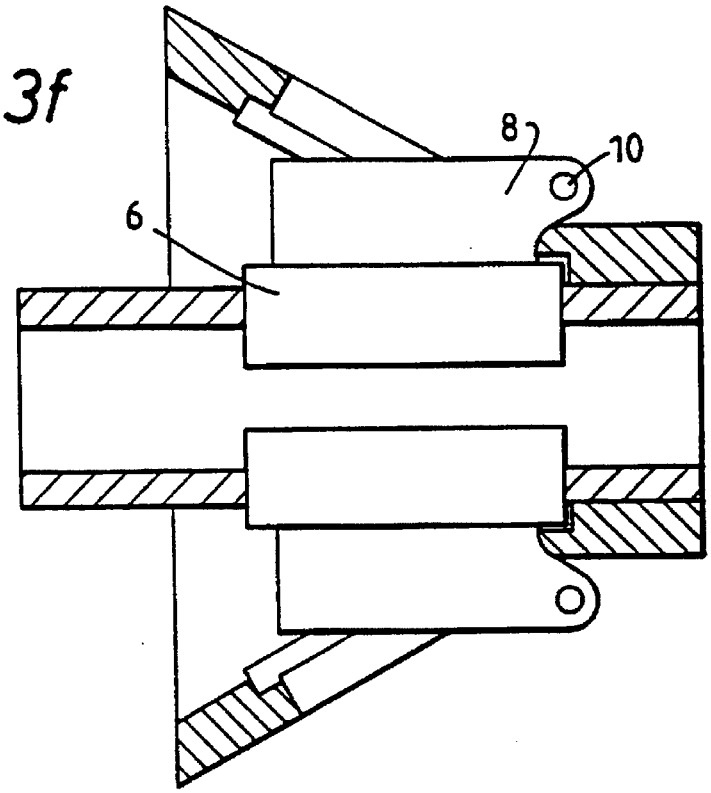

As the exhaust gas pressure decreases towards the end of the cycle the supporting ribs 8 rotate back around the pivot 10 under the influence of the spring biasing (FIG. 3*d, e*), so that the muzzle brake returns to the fully closed configuration at the end of the cycle (FIG. 3*f*).

FIG. 4 illustrates an alternative embodiment of the invention. As with the previous embodiment, the muzzle brake comprises a hollow cylindrical tube 2 with two identical opposite apertures 4, each having an associated closure flap 6. For illustration purposes the upper closure flap is represented in the closed and the lower closure flap in a fully open position respectively. Mounted towards the forward end of the cylindrical tube 2 is a diametrically recessed annular disc 28 the rear surface of which constitutes a flat braking surface 30.

Each closure flap 6 is connected to a supporting rib 8 to which is attached a shaft 32. Each end of the shaft 32 is pivotably mounted through an aperture within a raised segment 29 of the diametrically recessed disc 28, so that its associated closure flap 6 is movable to and from a closed position. Each flap 6 is spring biased into the closed position by a pair of semi-loop springs each comprising a 2.5 cm wide strip of carbon spring steel 22 mounted between a mounting plate 24 on the supporting rib 8 and a base plate 26 fixed to the forward surface of the diametrically recessed disc 28. Strip thicknesses of the order of 0.25 mm–0.4 mm are found to give adequate flexibility with strength and are readily available. Paired springs are preferred as offering greater reliability in operation.

In use the rearward end 7 of the hollow cylindrical tube 2 is attached to a muzzle of a gun barrel. As with the previous embodiment, the springs are of a resilience which produces an aperture closure system the inertia of which is such that the blast pressure wave which follows the firing of the gun is of insufficient duration to cause the apertures 4 to be opened significantly and passes through substantially unhindered. Under the influence of exhaust gas pressure the supporting ribs 8 and shafts 32 pivot opening the apertures 4 to allow exhaust gases to pass through. These are deflected rearwards by the internal surfaces 13 of the flaps 6 and the braking surface 30 to produce a braking effect as before. Recoil attenuation efficiencies of 70% or higher can be achieved, offering a significant improvement over simple metal block brakes. The extent to which a supporting rib 8 can pivot is restricted by a flap limiter 34, defining a fully open configuration as illustrated by the lower part of FIG. 4.

As gas pressure recedes towards the end of the exhaust phase the resilience of the semi-loop springs 22 cause each flap 6 and its associated supporting rib 8 to move back towards the closed position via the pivoting action of the attached shaft 32. At the end of the exhaust phase the flaps 6 have returned to position so as to fully close the arcuate apertures 4 in the cylindrical tube 2 and the muzzle brake is ready for the firing of the next round.

The embodiment illustrated in FIGS. 5 and 6 similarly comprises a hollow cylindrical tube 2 with two identical opposite apertures 4 and closure flaps 6, with the upper closure flap illustrated in the closed and the lower closure flap in the fully open position respectively. Mounted towards the forward end 5 of the cylindrical tube 2 is a braking member 12 which has a rearwardly extending portion of increased diameter so as to define a rearwardly directed concave braking surface 14 and which is slotted in like manner to the equivalent member of the embodiment of FIGS. 1–3. Other than at the slotted areas the braking surface is frustoconical, and if notionally projected forwards to an apex would optimally have an apex angle of 110°.

At either side of each slot 15 the braking member 12 is configured to provide a shaft supporting lug 36 through which a shaft 32 is rotatably mounted. A flap support member 38 is fixedly connected between each shaft 32 and a closure flap 6 such that the arrangement is pivotable about the shaft 32 to move the flap 6 to and from a closed position.

Each shaft 32 extends laterally beyond the supporting lugs 36, and a strip of spring steel 40 is attached to and coiled around each lateral extension. Two spring mounting plates 42 are laterally mounted onto the braking member 12 so as to lie between the lateral extensions of the shaft 32, one to each side of the cylindrical tube 2. Each spring 40 is then attached to the nearest spring mounting plate 42 in a stressed state so as to bias its associated shaft, support member and flap arrangement into the closed configuration.

When a gun with this embodiment of muzzle brake attached is fired, the degree of spring biasing and the mass of shaft 32, support member 38 and closure flap 6 together provide an inertia to the system which retains each flap 6 substantially in the closed position during passage of the short duration blast pressure wave. Exhaust gas pressure overcomes this inherent inertia to cause the flaps 6 and support members 38 to move from the closed position via the pivoting action of the shaft 32 opening the apertures 4 to allow exhaust gases to pass through. These are deflected rearwards by the internal surfaces 13 of the flaps 6 and the concave braking surface 14 to produce a braking effect as before. With this embodiment of muzzle brake the extent to which a support member 38 can pivot will in practice be restricted, and a fully open position defined, by its impact with a flap limiter analogous to members 32 in FIG. 4 but omitted here for clarity. In an arrangement identical to that shown in these figures the extent to which a support member 38 can pivot will be restricted by impact of its associated closure flap 6 with the braking surface 14, which is a less desirable arrangement as distortion of the closure flaps could result. As exhaust gas pressure recedes the flaps 6 return to the closed position under the influence of spring biasing in like manner to the other embodiments.

The embodiment illustrated in FIGS. 7 and 8 is broadly similar to that illustrated in FIGS. 5 and 6 and like components are labelled with like numerals. Both figures illustrate the upper closure flap in the closed and the lower closure flap in the fully open position respectively.

This embodiment differs from the embodiment illustrated in FIGS. 5 and 6 in that the flap support member 38 includes a forward extension 46 to which is attached a muzzle closure flap 48. Exhaust gas pressure overcomes the spring biasing to cause the flaps 6 and support members 38 to move from the closed position via the pivoting action of the shaft 32. The arrangement pivots to a fully open position (as illustrated by the lower flap, support and shaft arrangement in FIGS. 7 and 8) wherein the muzzle closure flap 48 attached to the forward extension 46 of each support member 38 covers a semicircular segment of the circular aperture 3 at the forward end of the hollow cylindrical tube 2. With both of the muzzle closure flaps 48 in this position the passage of exhaust gases through the aperture 3 is prevented, so that the flow of exhaust gases passing axially along the centre of the cylindrical tube 2, which was undeflected in previous embodiments, is diverted back along the tube and passes through the apertures 4. An enhanced braking effect is thereby produced. In this position the muzzle closure flap 48 also limits the extent of rotation of the shaft, support and flap arrangement, thereby performing an equivalent function to the flap limiter in previous embodiments (34 on FIG. 4). As exhaust gas pressure recedes the flaps 6 return to the closed position under the influence of spring biasing in like manner to the other embodiments.

The muzzle brake illustrated in FIGS. 9 and 10 shows alternative spring biasing means incorporated into a similar muzzle brake arrangement to those of FIGS. 5 to 8 and like components are labelled with like numerals. In this embodiment the muzzle brake is structurally continuous with the barrel of a gun. Apertures 4 are located towards the forward end of a gun barrel 54, and the remaining components are mounted thereon.

The four coiled strips of spring steel which constituted the biasing members of FIGS. 5–8 are replaced by four torsionally mounted helical springs 50. The braking member 12 is mounted on the gun barrel 54 forward of the apertures 4 and has a forward part configured to provide four spring mounting lugs 52. Each helical spring 50 is located coaxially around a lateral extension of a shaft 32 and is fixedly mounted between a spring mounting lug 52 and a forward extension 46 of a flap support member 38 in a torsionally stressed state so as to bias its associated shaft, support member and flap arrangement into the closed configuration. When the gun is fired the braking function is effected in like manner to earlier embodiments.

I claim:

1. A muzzle brake locatable at the forward end of a gun barrel which, when fired, provides a relatively short duration blast pressure wave followed by a relatively longer duration exhaust pressure wave, comprising:

a hollow cylindrical tube having an open forward end and having at least two apertures in the cylinder wall, each of the apertures being provided with associated closure means mounted on the hollow cylindrical tube so as to be movable between a closed position and a fully open position wherein each of the closure means has at least one associated biasing member acting on the closure means to bias the closure means into the closed position, said biasing members being preloaded to a predetermined level so as to introduce an inertia into the movement of the closure means such that the gases produced during the blast pressure wave, which immediately follows firing of a gun, pass through the muzzle brake without effecting significant opening of the closure means and permitting opening of the closure means during said exhaust pressure wave, and at least one surface which functions as a rearwardly directed gas deflecting surface when the closure means are in an open position.

2. A muzzle brake locatable at the forward end of a gun barrel comprising:

a hollow cylindrical tube having an open forward end and having at least two apertures in the cylinder wall, each of the apertures being provided with associated closure means mounted on the hollow cylindrical tube so as to be movable between a closed position and a fully open position wherein each of the closure means has at least one associated biasing member acting on the closure means to bias the closure means into the closed position, said biasing members being preloaded to a predetermined level so as to introduce an inertia into the movement of the closure means such that the gases produced during the blast pressure wave, which immediately follows firing of a gun, pass through the muzzle brake without effecting significant opening of the closure means, and at least one surface which functions as a rearwardly directed gas deflecting surface when the closure means are in an open position wherein each of the closure means is mounted so as to rotate about an axis located between its associated aperture in the cylinder wall and the forward end of the cylindrical tube.

3. A muzzle brake locatable at the forward end of a gun barrel comprising:

a hollow cylindrical tube having an open forward end and having at least two apertures in the cylinder wall, each of the apertures being provided with associated closure means mounted on the hollow cylindrical tube so as to be movable between a closed position and a fully open position wherein each of the closure means has at least one associated biasing member acting on the closure means to bias the closure means into the closed position, said biasing members being preloaded to a predetermined level so as to introduce an inertia into the movement of the closure means such that the gases produced during the blast pressure wave, which immediately follows firing of a gun, pass through the muzzle brake without effecting significant opening of the closure means, and at least one surface which functions as a rearwardly directed gas deflecting surface when the closure means are in an open position, further comprising at least one braking member fixedly located towards the forward end of the cylindrical tube and having a rearwardly facing braking surface configured such that in use the at least one braking surface contributes to rearward deflection of gases exiting the muzzle brake via the apertures.

4. A muzzle brake according to claim 3 comprising a single braking member having a rearwardly facing braking surface providing a rearwardly directed gas deflecting surface which is continuous about the circumference of the muzzle brake.

5. A muzzle brake according to claim 3 wherein the at least one braking member is so configured as to combine with the closure means so that the braking surface of the at least one braking member and the internal surfaces of the closure means when in the fully open position provide a rearwardly directed gas deflecting surface which is effectively continuous about the circumference of the muzzle brake.

6. A muzzle brake according to claim 4 wherein the rearwardly directed gas deflecting surface is concave.

7. A muzzle brake according to claim 6 wherein the gas deflecting surface is predominantly frustoconical.

8. A muzzle brake according to claim 7 wherein the frustoconical gas deflecting surface has a projected apex angle of between 80° and 140°.

9. A muzzle brake according to claim 8 wherein the projected apex angle is between 100° and 120°.

10. A muzzle brake according to claim 1 wherein the apertures in the cylinder wall are identical in size and circumferentially equispaced.

11. A muzzle brake according to claim 10 wherein the apertures are arcuate.

12. A muzzle brake according to claim 1 wherein each closure means is fixed with respect to a shaft, which shaft is pivotably mounted on the muzzle brake such that its associated closure means is movable between a closed position and a fully open position.

13. A muzzle brake according to claim 1 wherein each biasing member comprises a semi-loop spring.

14. A muzzle brake according to claim 12 wherein each biasing member acts directly on a shaft.

15. A muzzle brake according to claim 14 wherein each biasing member comprises a coil spring.

16. A muzzle brake according to claim 14 wherein each biasing member comprises a torsionally mounted helical spring.

17. A muzzle brake locatable at the forward end of a gun barrel comprising:

a hollow cylindrical tube having an open forward end and having at least two apertures in the cylinder wall, each of the apertures being provided with associated closure means mounted on the hollow cylindrical tube so as to be movable between a closed position and a fully open position wherein each of the closure means has at least one associated biasing member acting on the closure means to bias the closure means into the closed position, said biasing members being preloaded to a predetermined level so as to introduce an inertia into the movement of the closure means such that the gases produced during the blast pressure wave, which immediately follows firing of a gun, pass through the muzzle brake without effecting significant opening of the closure means, and at least one surface which functions as a rearwardly directed gas deflecting surface when the closure means are in an open position, wherein each closure means is provided with a forward extension and muzzle closure flap which are so configured that when all the closure means are in the fully open position their respective muzzle closure flaps together substantially close the forward end of the cylindrical tube.

18. A muzzle brake according to claim 1 wherein the hollow cylindrical tube has a rearward end connectable to the muzzle of a gun.

* * * * *